United States Patent [19]

Nederveld

[11] 4,441,649

[45] Apr. 10, 1984

[54] COLLAPSIBLE RECEPTACLE

[75] Inventor: Terril L. Nederveld, Ada, Mich.

[73] Assignee: Packaging Corporation of America, Evanston, Ill.

[21] Appl. No.: 415,404

[22] Filed: Sep. 7, 1982

[51] Int. Cl.[3] ..... B65D 5/10

[52] U.S. Cl. ..... 229/38; 206/386; 229/37 R; 229/41 C

[58] Field of Search ..... 229/38, 41 C, 41 D, 229/39 R, 37 R, 23 R; 220/443; 206/386, 600; 428/182

[56] References Cited

U.S. PATENT DOCUMENTS

| | | | |
|---|---|---|---|
| 3,518,142 | 6/1970 | Dooley | 428/182 X |
| 4,089,417 | 5/1978 | Osborne | 206/600 |
| 4,260,100 | 4/1981 | Hoffman | 229/41 C X |
| 4,296,860 | 10/1981 | Hsu et al. | 229/23 R |

*Primary Examiner*—William Price
*Assistant Examiner*—Gary E. Elkins
*Attorney, Agent, or Firm*—Neuman, Williams, Anderson & Olson

[57] ABSTRACT

A collapsible receptacle is provided having upright first wall panels, upright second wall panels, and upright corner panels, all of which coact to define a predetermined area. Each corner panel is disposed between and foldably connected to adjoining first and second wall panels. Foldably connected to the bottom edges of the first wall panels are bottom-forming first flaps, and foldably connected to the corresponding bottom edges of the second wall panels are bottom-forming second flaps. Disposed at opposite ends of each first flap and foldably connected thereto are laterally extending extension flaps. The edge of each extension flap opposite the folding connection thereof is provided with an offset shoulder. The shoulders formed on corresponding extension flaps are disposed in abutting relation with opposite ends of the folding connection between an adjacent second wall panel and the corresponding second flap. A substantial portion of each extension flap projects outwardly from a corner panel.

8 Claims, 9 Drawing Figures

COLLAPSIBLE RECEPTACLE

BACKGROUND OF THE INVENTION

In the bulk handling of various types of articles (e.g. fresh produce, etc.) for transporting to a storage facility or directly to the customer, it is customary for such articles to be accommodated in various types of receptacles. Such receptacles must be of rugged construction to withstand the substantial weight of the contents and the frequent rough or abusive handling to which it is subjected. Furthermore, the receptacle must be of simple, inexpensive construction; easily loaded and unloaded; capable of being reused; and adapted to be collapsed when not in use for compact storage.

Various receptacles of this general type have heretofore been used; however, because of various inherent design characteristics they have been incapable of fulfilling the aforenoted criteria.

SUMMARY OF THE INVENTION

Thus, it is an object of this invention to provide an improved receptacle which avoids all the inherent design shortcomings associated with prior receptacles of this general type.

It is a further object of the invention to provide an improved receptacle which may be readily set up manually by a single individual without the need for special tools or fixtures.

It is a still further object to provide an improved receptacle which is capable of safely accommodating a wide variety of articles.

It is a still further object to provide an improved receptacle which is capable of being stacked, when loaded, and being adapted for use with pallets.

Further and additional objects will appear from the description, accompanying drawings, and appended claims.

In accordance with one embodiment of the invention, a collapsible receptacle is provided which is formed from a blank of foldable sheet material, such as triple-wall corrugated fibreboard. The receptacle includes a plurality of upright first wall panels; a plurality of upright second wall panels; and a plurality of corner panels which coact with the wall panels to delimit a predetermined area. A corner panel is disposed between and foldably connected to adjoining first and second wall panels. Foldably connected to the bottom edges of the first and second wall panels are bottom-forming first and second flaps, respectively. Disposed at opposite ends of each first flap and foldably connected thereto are laterally extending extension flaps. The edge of each extension flap opposite the folding connection thereof is provided with an offset shoulder. Each shoulder abuttingly engages an end of the folding connection between an adjacent second wall panel and the bottom-forming second flap and thus, retains the wall and corner panels in a predetermined relation. The first and second flaps and first portions of the extension flaps are folded relative to one another and disposed within the predetermined area. Each extension flap subtends a corner panel. A second portion of each extension flap projects outwardly from the corner panel subtended thereby.

DESCRIPTION

For a more complete understanding of the invention reference should be made to the drawings wherein.

Figure 1:
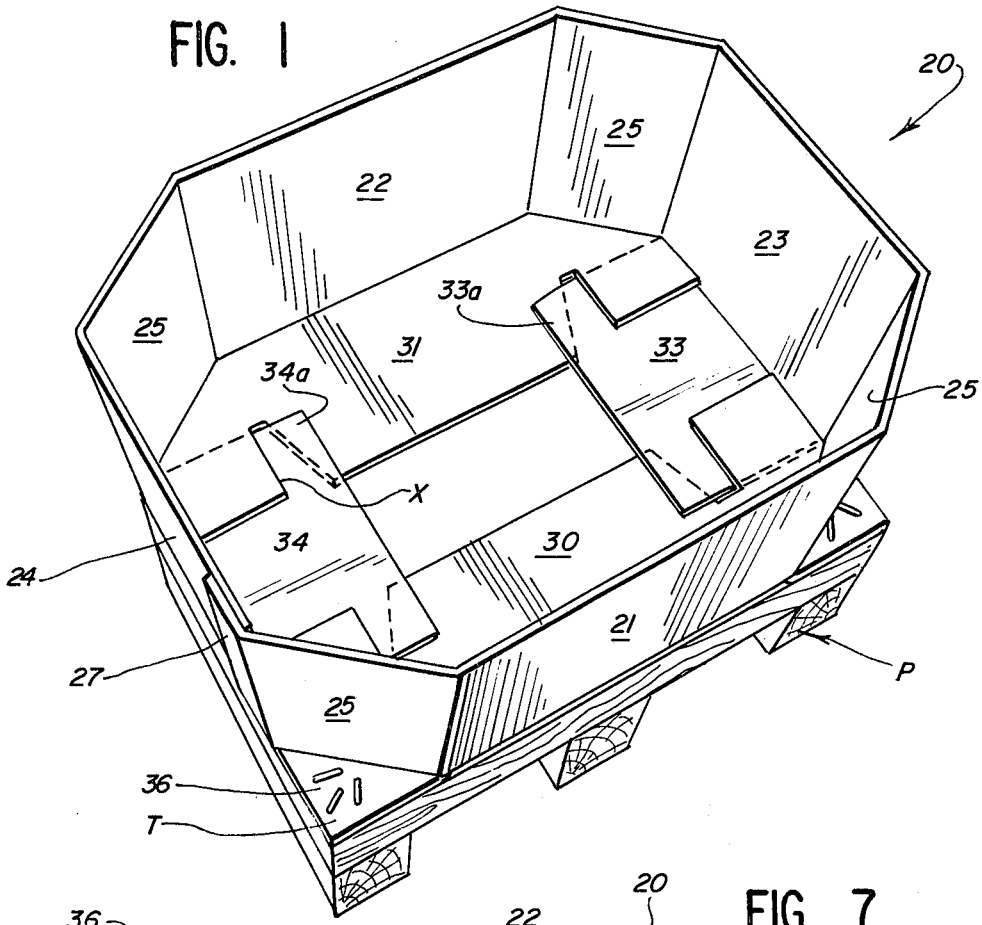
FIG. 1 is a perspective top view of one embodiment of the improved receptacle shown secured to a conventional pallet.
Figure 7:
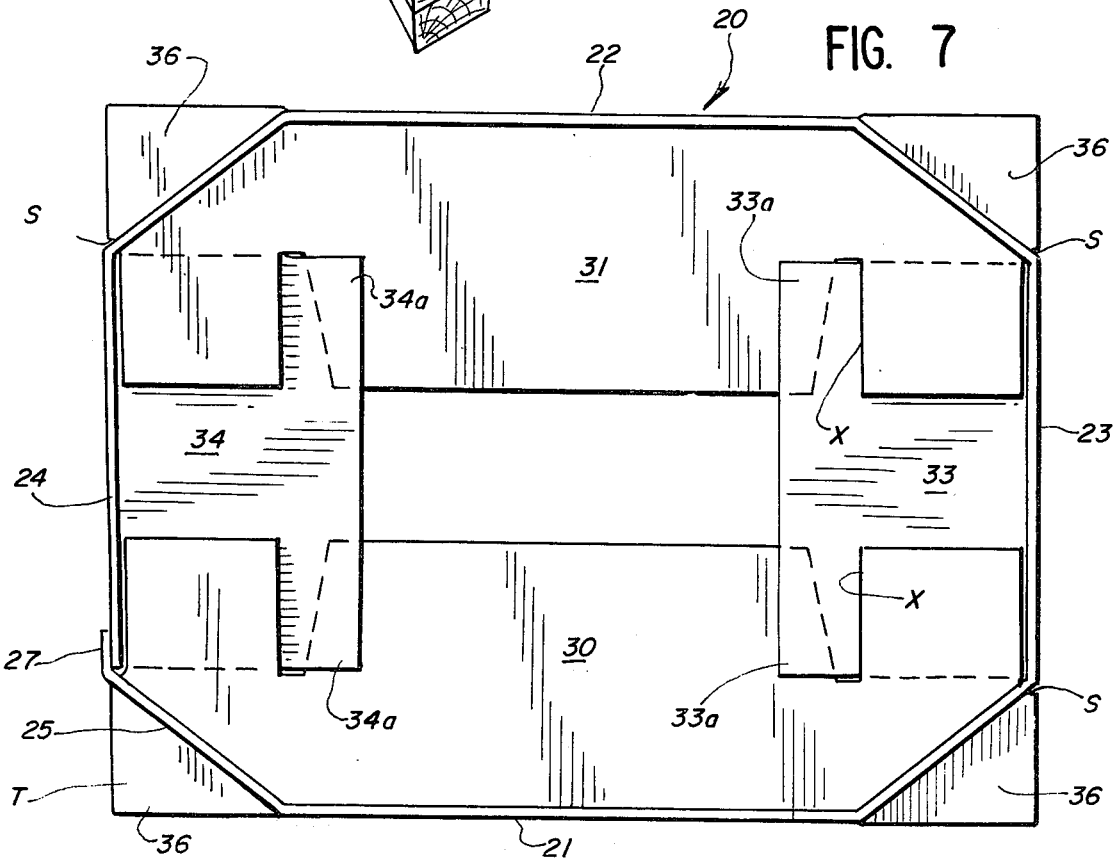
FIG. 7 is an enlarged top plan view of the receptacle of FIG. 1, shown disassembled from the pallet.

Referring now to the drawings and more particularly to FIGS. 1 and 7, one embodiment of the improved receptacle 20 is shown which is particularly suitable for accommodating in bulk a plurality of individual articles, such as fresh produce (e.g. watermelons, cantaloupes, etc.). In FIG. 1 the receptacle is shown attached by suitable fasteners, such as staples, to a conventional wooden pallet P. When assembled with the pallet, a loaded receptacle may be readily handled by a fork-lift truck in a conventional manner.

Figure 2:
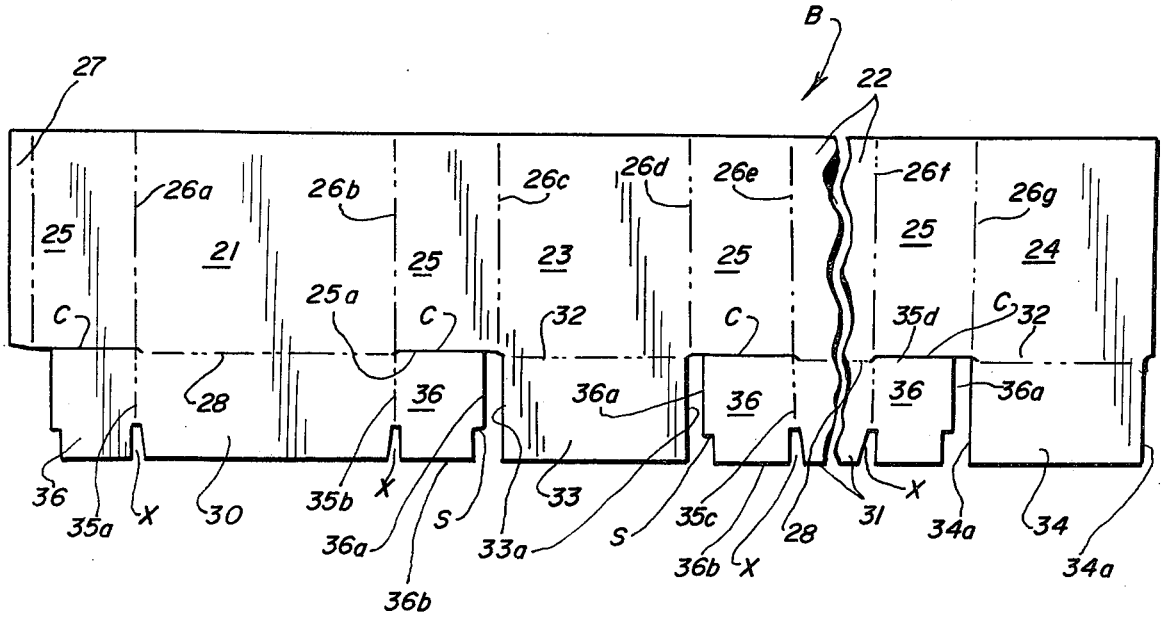
FIG. 2 is a fragmentary plan view, on a reduced scale, of the blank for the receptacle shown in FIG. 1.
Figure 8:
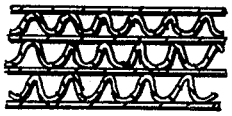
FIG. 8 is an enlarged fragmentary sectional view taken along line 8—8 of FIG. 6.

The receptacle 20 may be readily formed from a blank B of foldable sheet material such as conventional triple-wall corrugated fibreboard, see FIG. 8. The blank B as seen in FIG. 2 includes a pair of side wall panels 21, 22; a pair of end wall panels 23, 24; and a plurality (e.g. four) of corner panels 25. In the illustrated blank, the panels thereof are arranged in the following order: a corner panel 25, a side wall panel 21, a corner panel 25, an end wall panel 23, a corner panel 25, a side wall panel 22, a corner panel 25, and an end wall panel 24. The adjacent panels are connected to one another by a plurality of elongated foldlines 26*a–g* which are arranged in spaced parallel relation. A conventional connecting flap 27 may be foldably connected to one of the end-most panels.

Foldably connected by a foldline 28 to the bottom edge of each side panel 21, 22 is a bottom-forming flap 30, 31, respectively. Also foldably connected by a foldline 32 to the bottom edge of each end panel 23, 24 is a bottom-forming flap 33, 34, respectively. In blank B flaps 30, 31 are of like configuration as is also the case of flaps 33, 34.

Disposed at opposite ends of each flap 30, 31 and connected thereto by foldlines 35*a–d* are extension flaps 36. Each extension flap foldline 35*a–d* is in end-alignment with a corresponding foldline 26*a*, 26*b*, 26*e*, or 26*f* which connects a corner panel 25 to the side panel 21, 22.

Foldlines 28, 32 which connect the bottom-forming flaps 30, 31 and 33, 34 to the side panels 21, 22 and end panels 23, 24, respectively, are disposed in end alignment, as seen in FIG. 2. The foldlines 28, 32 are disposed in substantially perpendicular relation with respect to foldlines 26*a–g*, 35*a–d*.

Each extension flap 36 is separated from an adjacent corner panel 25 by a suitable cut C which is disposed substantially normal to one of the extension flap foldlines 35*a–d*. The edge of each extension flap 36 opposite the foldline 35*a–d* has formed therein an inwardly offset shoulder S. The function of the shoulders will be described more fully hereinafter. While the shouldered edge 36*a* of each extension flap 36 is shown in FIG. 2 as being spaced a substantial distance from the end edge 33*a*, 34*a* of the adjacent bottom-forming flap 33, 34, such an amount of spacing is not essential.

Each foldline 35*a–d* connecting an extension flap 36 to an adjacent flap 30, 31 has one end thereof terminating at the cut C and the opposite end thereof terminating in an elongated slot X. The depth of each slot is approximately equal to the distance shoulder S is recessed from the edge 36*b* of the extension flap 36.

Figure 3:
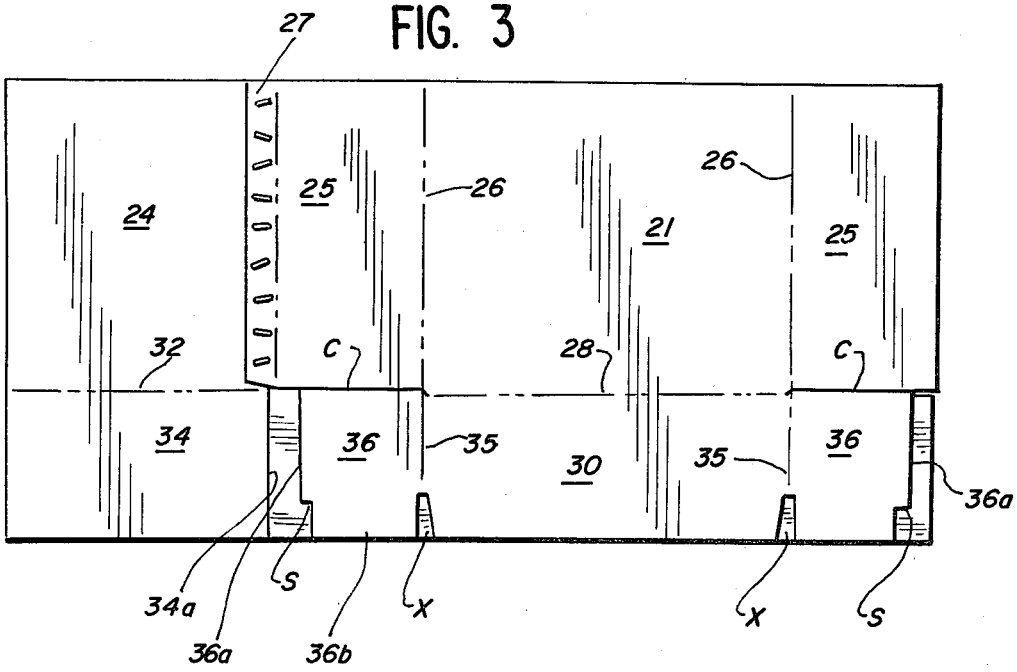
FIG. 3 is a side elevational view of the receptacle of FIG. 1 in a collapsed state and disassembled from the pallet.

In setting up blank B to form receptacle 20, end panels 23, 24; side panel 22; associated bottom-forming flaps; and the two corner panels 25, disposed on opposite sides of side panel 22, are folded as a unit about foldline 26*c* so as to underlie the remaining panels and flaps. While the blank is in this initial folded state, end panel 24 and associated flap 34 are folded as a unit about foldline 26*g* so as to partially overlie side panel 22. End panel 24 is then disposed contiguous to the corner panel 25 and the flap 27 connected to the corner panel is secured by staples or the like to panel 24 in a conventional manner, see FIG. 3. With the blank in the folded or collapsed state shown in FIG. 3, it may be readily stored for further use or it may be returned to the original user for reuse.

Figure 4:
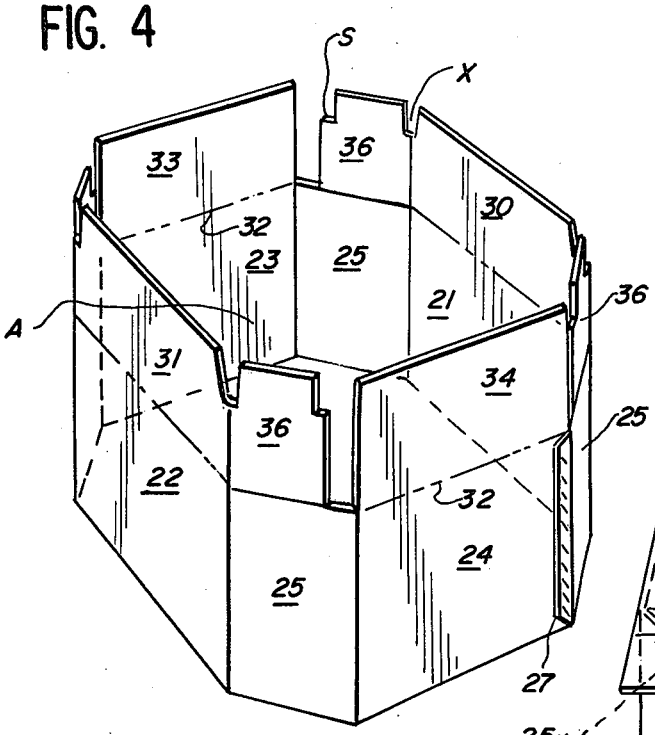
FIGS. 4–6 are perspective views of successive stages of setting up the improved receptacle from the collapsed state of FIG. 3.

After blank B has assumed the collapsed state (FIG. 3), it is then squared up and inverted so that the bottom-forming flaps extend upwardly as seen in FIG. 4. While the squared-up condition, the side, end, and corner panels coact with one another to delimit a predetermined area A. It will be noted in the illustrated embodiment that single panels 21, 22 are in opposed substantially parallel relation as is also the case with end panels 23, 24. Corner panels 25, in turn, are obliquely disposed relative to the side and end panels to which they are connected.

Figure 5:
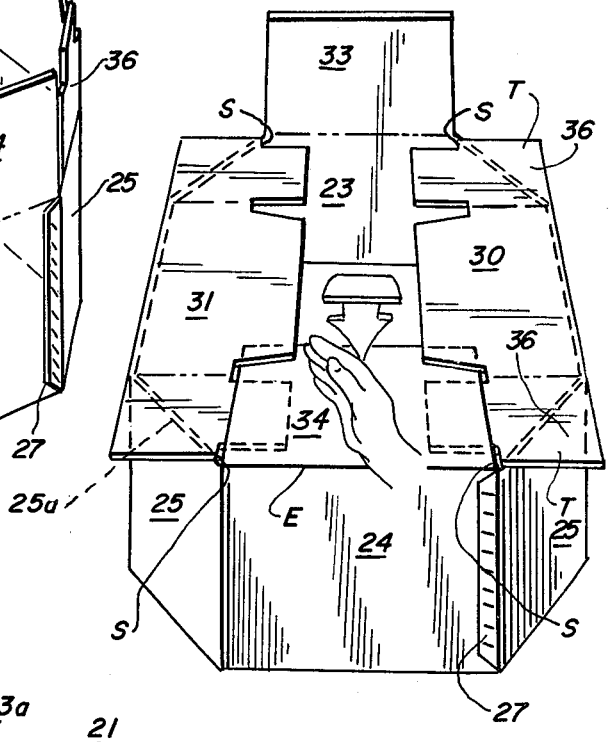

Flaps 30, 31 with the extension flaps 36 connected thereto are then folded approximately 90° towards one another into the area A, see FIG. 5. The extension flaps 36, in turn, contact the edges 25*a* of the corresponding corner panels 25 which are formed by the cuts C in the blank B, see FIG. 2. The corner panel edges 25*a*, as will hereinafter become apparent, eventually become the lower or bottom edges when the receptacle is set up for loading, see FIG. 1.

Figure 6:
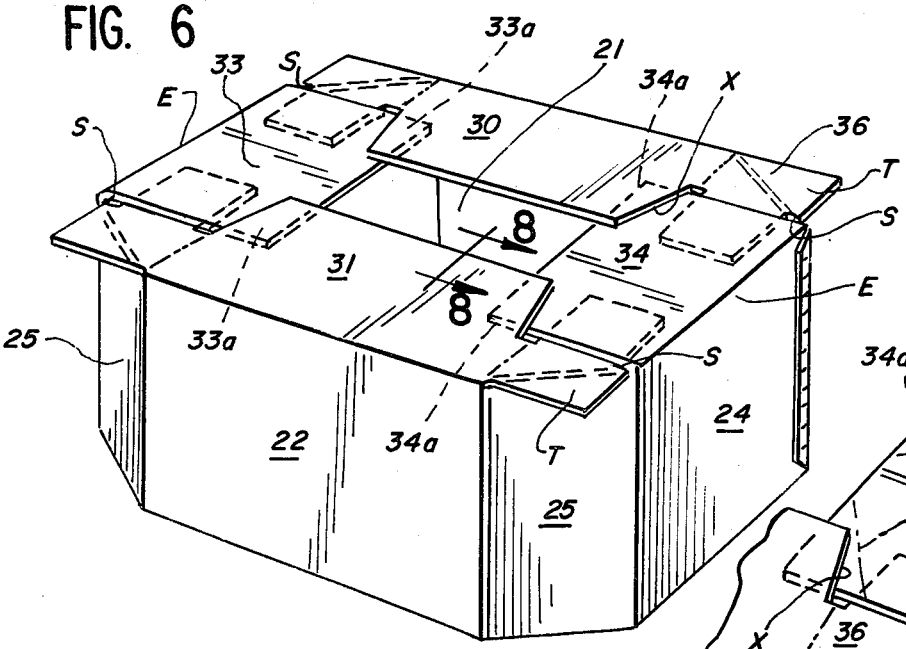

Because of the oblique or diagonal disposition of each corner panel 25, when the blank is squared up as shown in FIG. 5, a substantial triangular portion T of each extension flap 36 projects outwardly beyond the respective corner panel 25, see FIGS. 5 and 6. Once the flaps 30, 31 and associated extension flaps 36 have assumed the horizontal positions as shown in FIG. 5, bottom-forming flaps 33, 34 are manually folded relative to the respective end panels 23, 24 towards one another and downwardly a sufficient amount so that the free corner segments 33*a*, 34*a* of the flaps 33, 34 will automatically slip into the slots X formed in the adjacent flaps 30, 31. Because of the resilient character of the fibreboard material and the configuration of the various flaps and the slots X, both the corner segments 33*a*, 34*a* and the adjacent flap 30, 31 and associated extension flaps 36 will distort the required amount during the inward and downward folding of the flaps 33, 34 so as to facilitate entry of the corner segments into the respective slots. Once the corner segments have entered the slots, the flaps will quickly return to their normal shape and thus, result in an effective interlocking of the bottom-forming flaps.

It is important to note, that when flaps 33, 34 are folded inwardly toward one another, the foldlines 32 connecting the flaps to the respective end panels, form elongated exterior edges E, the ends of which are in abutting relation with the shoulders S formed on the adjacent extension flaps. By reason of this abutting relation, the upright end and corner panels are retained in the desired angular relation with respect to one another.

As will be noted in FIG. 6, the corner segments 33*a*, 34*a* of flaps 33, 34 are disposed beneath the respective end portions of the flaps 30, 31, thereby resulting in an effective interlocking of the bottom-forming flaps 30, 31, 33, 34.

Once the blank has assumed the setup condition, shown in FIG. 6, it is manually turned over and spotted on the exposed surface of the pallet P, see FIG. 1. It will be noted in FIG. 1 that the projecting portions T of the extension flaps 36 are readily accessible for stapling or otherwise securing same to the pallet if desired.

Where the receptacle 20 is not to be used in combination with a pallet P, it may rest directly on a supporting surface or the ground. Because of the projecting portions T of the extension flaps 36, the receptacle is provided with greater stability.

Figure 9:
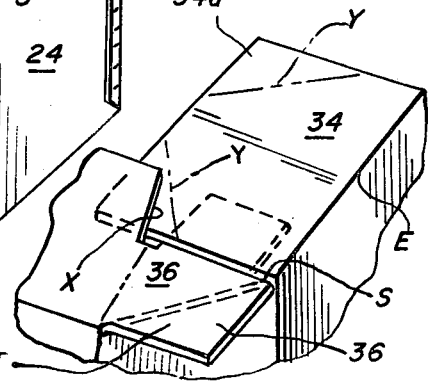
FIG. 9 is a fragmentary perspective view similar to FIG. 6 of one corner of the bottom of a modified receptacle.

When the receptacle 20 is loaded, the weight of the accommodated articles will exert a force on the bottom-forming flaps and help to retain the latter in their proper folded condition. Where the receptacle is to be affixed to a pallet, it is not essential that the flaps assume an interlocking relation, but merely that they overlap one another. In any case, however, it is important that the shoulders on the extension flaps abut the opposite ends of the formed exterior edges E so that the side, end, and corner panels will retain their proper relative upright positions.

Where the dimensions and configuration of the flaps 33, 34 and/or the stiffness of the blank material are such that the flaps 33, 34 will not readily distort, when manual force is applied as shown in FIG. 5, so as to effect interlocking of the flaps, the corner segments 33*a*, 34*a* may be defined in part by diagonal foldlines Y provided on the flaps 33, 34. FIG. 9 shows only flap 34 embodying the foldlines Y. Thus, with the foldlines Y, the corner segments can be manually folded downwardly so as to be readily inserted through the respective slots X as the flaps 33, 34 are folded towards one another into the predetermined area A.

The improved receptacle 20 has been described herein with the bottom-forming flaps 30, 31 and associated extension flaps 36 being connected to the side panels 21, 22; however, the invention is not intended to be limited thereto, because, if desired, such flaps can be connected instead to the end panels 23, 24. Furthermore, the dimensions of the flaps 30, 31 may be modified so that the elongated free edges of the flaps 30, 31 would abut one another, thus effectively closing the bottom of the receptacle.

In certain instances it is necessary that the top of the receptacle be closed, in which case such closing can be accomplished by either a conventional telescoping cover or by having conventional closure flaps foldably connected to the upper edges of the side, end, and corner flaps.

The bottom dimension of the receptacle may conform substantially to the entire surface area of the pallet or to just a portion thereof. In the latter case, a plurality of receptacles could then be supported on a single pallet surface. The shape, size, and location of the slots may be varied, as desired, to facilitate manual interlocking of the bottom-forming flaps.

Thus, it will be noted that a strong, versatile, inexpensive receptacle has been provided which is capable of accommodating a wide variety of articles. The improved receptacle is capable of assuming a collapsed state for compact storage or returning to a predetermined location for subsequent reloading. The receptacle may be readily set up manually by a single individual without the need for special tools or fixtures.

Further, modifications to the receptacle and/or blank may be made without departing from the scope of the invention.

I claim:

1. A collapsible receptacle formed from a blank of foldable sheet material, comprising upright first wall panels; upright second wall panels; upright corner panels, each corner panel being foldably connected to and disposed intermediate adjoining first and second wall panels, said first, second, and corner panels coacting to delimit a predetermined area; bottom-forming first flaps foldably connected to bottom edges of said first wall panels and extending therefrom towards one another into the predetermined area; extension flaps connected to opposite ends of each first flap and extending laterally therefrom, an outer edge of each extension flap being provided with an offset shoulder, corresponding extension flaps being foldable with said first flaps into opposed relation; and bottom-forming second flaps foldably connected to bottom edges of said second wall panels and extending therefrom towards one another into the predetermined area and at least partially subtending corresponding extension flaps; the opposite ends of each folding connection between a second wall panel and a bottom-forming second flap being interposed and in substantially abutting relation with the shoulders formed in corresponding opposed extension flaps.

2. The receptacle of claim 1 wherein each extension flap subtends the bottom edge of a corner panel; a substantial first portion of each extension flap projects outwardly from a corresponding corner panel.

3. The receptacle of claim 1 wherein a side edge of each extension flap is provided with an elongated slot; each slot interlockingly accommodating a side edge portion of an adjacent bottom-forming second flap.

4. The receptacle of claim 3 wherein the slots of said extension flaps are disposed within said predetermined area; pairs of slots being in opposed substantially aligned relation.

5. The receptacle of claim 2 wherein each extension flap has a substantial second portion disposed within the predetermined area and overlying a side edge portion of an adjacent bottom-forming second flap.

6. A blank of foldable sheet material for a collapsible receptacle having upright wall panels and corner panels coacting to define a predetermined area and a plurality of flaps coacting to form a receptacle bottom, said blank comprising a plurality of first wall panels; a plurality of second wall panels alternately arranged in spaced side-by-side relation with said first wall panels; a plurality of corner panels, one of said corner panels being interposed each pair of first and second wall panels and being foldably connected thereto; a plurality of bottom-forming first flaps foldably connected to corresponding bottom edges of said first wall panels; a plurality of bottom-forming second flaps foldably connected to corresponding bottom edges of said second wall panels; and a pair of extension flaps connected to opposite ends of said first flaps; the folding connection between an extension flap and a first flap being angularly disposed relative to the folding connection between said first flap and a first wall panel, each extension flap being adjacent a corner panel and separated therefrom by a cut extending angularly from the folding connection of said extension flap, each extension flap having an edge opposite the folding connection thereof separated from an adjacent edge of a bottom-forming second flap and having a portion thereof spaced a substantial distance outwardly from said cut and offset toward the extension flap folding connection and forming a shoulder, the latter being in abutting engagement with an end of the folding connection between a second wall panel and a bottom-forming second flap when said blank is set up to form the receptacle.

7. The blank of claim 6 wherein a folding connection between is provided an extension flap and a bottom-forming first flap and is in endwise alignment with the folding connection between a first wall panel and a corner panel.

8. The blank of claim 7 wherein one end of the folding connection of each extension flap terminates in a longitudinally extending slot; each slot being adapted to interlockingly accommodate a side portion of a bottom-forming second flap when said blank is set up to form the receptacle.

* * * * *

UNITED STATES PATENT AND TRADEMARK OFFICE

CERTIFICATE OF CORRECTION

PATENT NO. : 4,441,649

DATED : April 10, 1984

INVENTOR(S) : Terril L. Nederveld

It is certified that error appears in the above-identified patent and that said Letters Patent is hereby corrected as shown below:

Column 3, line 29, "further" should be --future--.

Column 3, line 34, "in" should be inserted before "the" (first occurrence).

Column 3, line 37, "single" should be --side--.

Column 6, line 41, "between" should be repositioned after "provided".

Signed and Sealed this

*Thirtieth* Day of *October 1984*

[SEAL]

*Attest:*

GERALD J. MOSSINGHOFF

*Attesting Officer*

*Commissioner of Patents and Trademarks*